United States Patent [19]

Weant

[11] 4,373,189

[45] Feb. 8, 1983

[54] SIGNAL CONVERSION DEVICE

[76] Inventor: Charles M. Weant, 1806 Old Annapolis Blvd., Annapolis, Md. 21401

[21] Appl. No.: 182,290

[22] Filed: Aug. 28, 1980

[51] Int. Cl.[3] ..... G06J 1/00

[52] U.S. Cl. ..... 364/602; 328/21; 340/347 M; 364/607

[58] Field of Search ..... 364/600, 602, 607, 608; 340/347 SY, 347 AD; 328/14, 21-25

[56] References Cited

U.S. PATENT DOCUMENTS

| | | | |
|---|---|---|---|
| 2,798,992 | 9/1957 | Adler et al. | 318/592 |
| 2,885,614 | 5/1959 | Harris | 318/592 |
| 3,139,572 | 6/1964 | Evans | 318/592 |
| 3,593,095 | 7/1971 | Davis | 318/692 |
| 3,670,308 | 6/1972 | Tutelman | 364/900 |
| 3,701,936 | 10/1972 | Martin et al. | 318/595 |
| 3,732,479 | 5/1973 | Wing et al. | 318/654 |
| 3,789,199 | 1/1974 | Kotwicki | 364/602 |
| 3,898,546 | 8/1975 | Haskins | 318/591 |
| 4,093,989 | 6/1978 | Flink et al. | 364/602 X |
| 4,096,576 | 6/1978 | Takashi et al. | 364/602 |
| 4,141,065 | 2/1979 | Sumi et al. | 364/602 X |
| 4,216,465 | 8/1980 | Huelsman et al. | 364/608 X |

*Primary Examiner*—Joseph F. Ruggiero
*Attorney, Agent, or Firm*—R. F. Beers; P. Schneider; J. G. Wynn

[57] ABSTRACT

A solid-state, signal conversion circuit for converting electrical, periodic analog signals to other analog signals of different amplitude and/or frequency and/or phase is disclosed. The input signal is demodulated, scaled and sampled and each sample converted, via an analog-to-digital (A/D) converter, to a digital word corresponding to the sample's amplitude. The digital words address a ROM which has other words stored at the addresses in correspondence with the desired values for a preselected output signal. Scaling means is used to keep the input signal to the A/D converter at a constant peak value regardless of fluctuations in the signal level. A comparator and subtractor are used to invert the downslope of input signals to avoid ambiguity problems when the output signal frequency is an even multiple of the input signal frequency.

4 Claims, 7 Drawing Figures

INPUT SIGNAL

OUTPUT SIGNAL

SCALING MEANS

SIGNAL CONVERSION DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to signal conversion apparatus and especially to devices for converting electrical, periodic, analog input signals to electrical output signals of different waveshape and/or frequency and/or phase.

There are many instances in which it would be highly desirable to convert electrical signals of one waveshape, phase and frequency to another waveshape, phase and/or frequency. A specific example is the conversion of one-speed synchro signals to two or thirty-six-speed signals which ordinarily is accomplished by synchro motors. It is highly desirable from a maintenance and reliability standpoint to effect this conversion with an absolute minimum of mechanical parts. Also, to eliminate errors, synchro converters require costly precision gearing and rotating parts.

SUMMARY OF THE INVENTION

An object of the invention is to convert a periodic, analog, electrical input signal into an output signal of different waveshape, and/or frequency, and/or phase.

Another object is to accomplish this and eliminate costly precision gearing and rotating components.

A further object is to accomplish this with solid-state components which will give greater reliability and require less maintenance than rotating devices.

The above and other objects are accomplished by utilization of a unique solid-state circuit for signal conversion. The circuit employs an analog-to-digital (A/D) converter to sample the envelope of a periodic analog input signal and produce a digital word for the amplitude of each sample. Each sample addresses a specific location, or address, in a read only memory (ROM), according to the amplitude of the sampled signal, and a digital word is read out of that address. The ROM is initially programmed to provide the type of output signal which is desired for a given input signal. The output of the ROM is then converted to an analog signal.

To prevent ambiguity when the system output signal is to be an even harmonic of the input signal, a subtraction technique is employed for each downslope of the input signal. Furthermore, the system includes a scaling amplifier and means to adjust for variations in input signal peak amplitude so as to maintain the output of the scaling amplifier at a constant peak value.

DETAILED DESCRIPTION OF THE INVENTION

Figure 1:
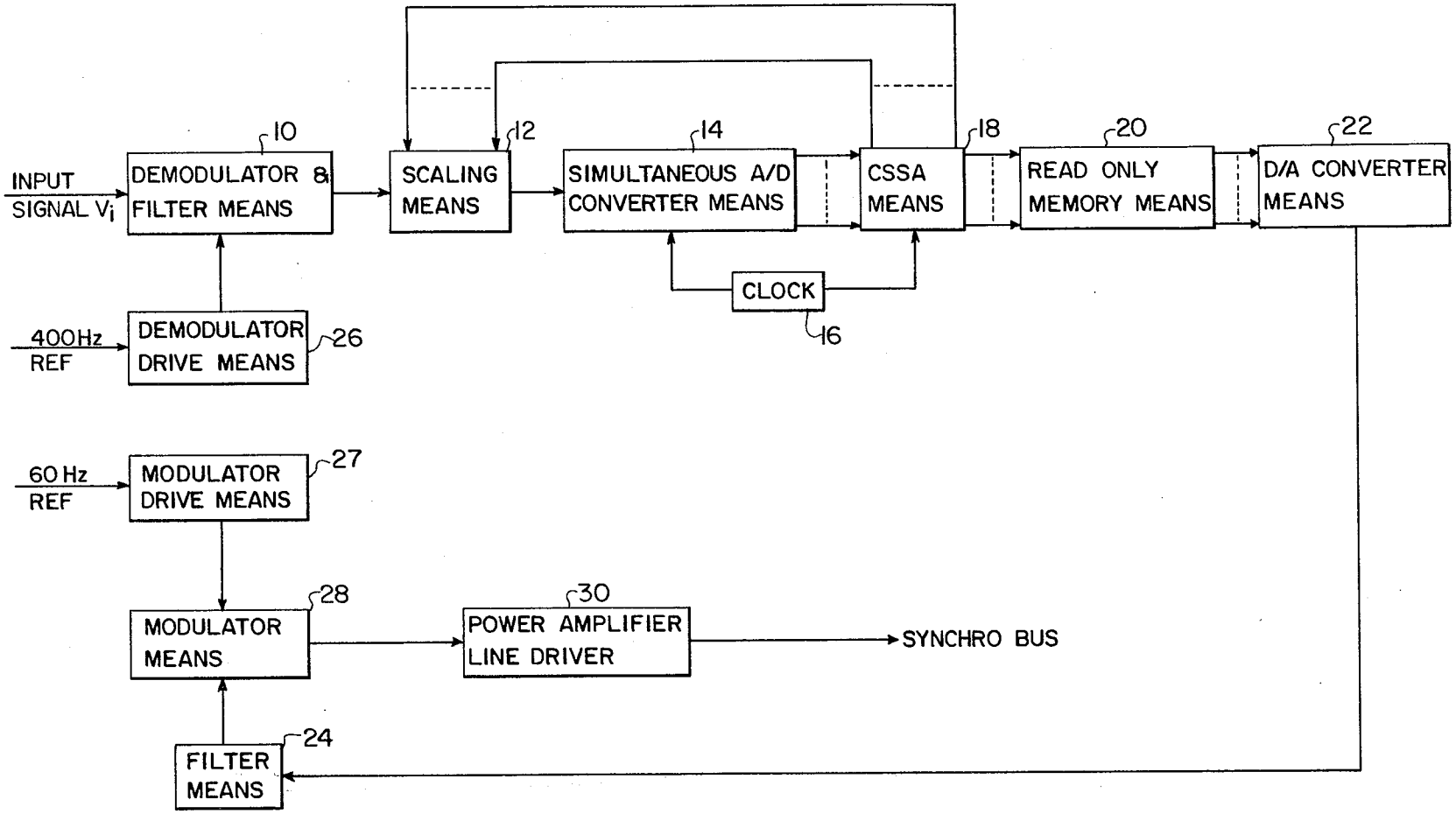
FIG. 1 is a block diagram of an embodiment of the invention.

FIG. 1 shows in block form an embodiment of the invention. The invention will be described herein with specific reference to signals from a synchro device, although the invention is broad enough to encompass conversion of all types of electrical periodic analog signals. The circuit shown in FIG. 1 can convert one phase of a 3-phase synchro signal. Two other similar circuits would, of course, be required for the other two phases.

Figure 2:
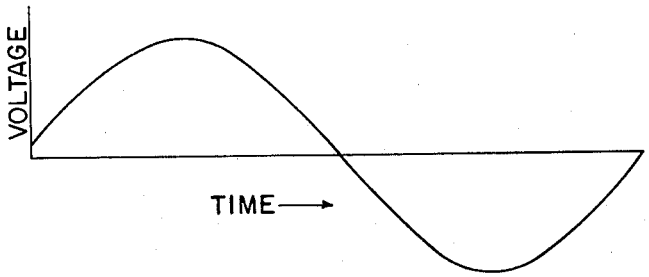
FIG. 2 is an illustration of one possible input signal.
Figure 3:
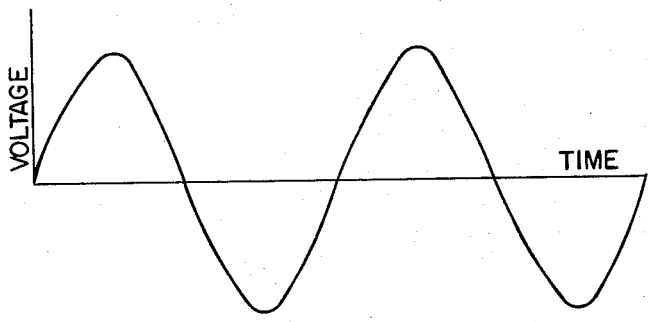
FIG. 3 is an illustration of a possible output signal which is different in amplitude and double the frequency of the input signal of FIG. 2.

A synchro signal is a modulated signal having a 60 Hz or 400 Hz carrier frequency. The demodulated input signal is a sine wave (FIG. 2), and it will be assumed that the desired unmodulated output signal is a sine wave of different peak amplitude and of twice the frequency (2-speed synchro signal) as shown in FIG. 3.

Figure 4:
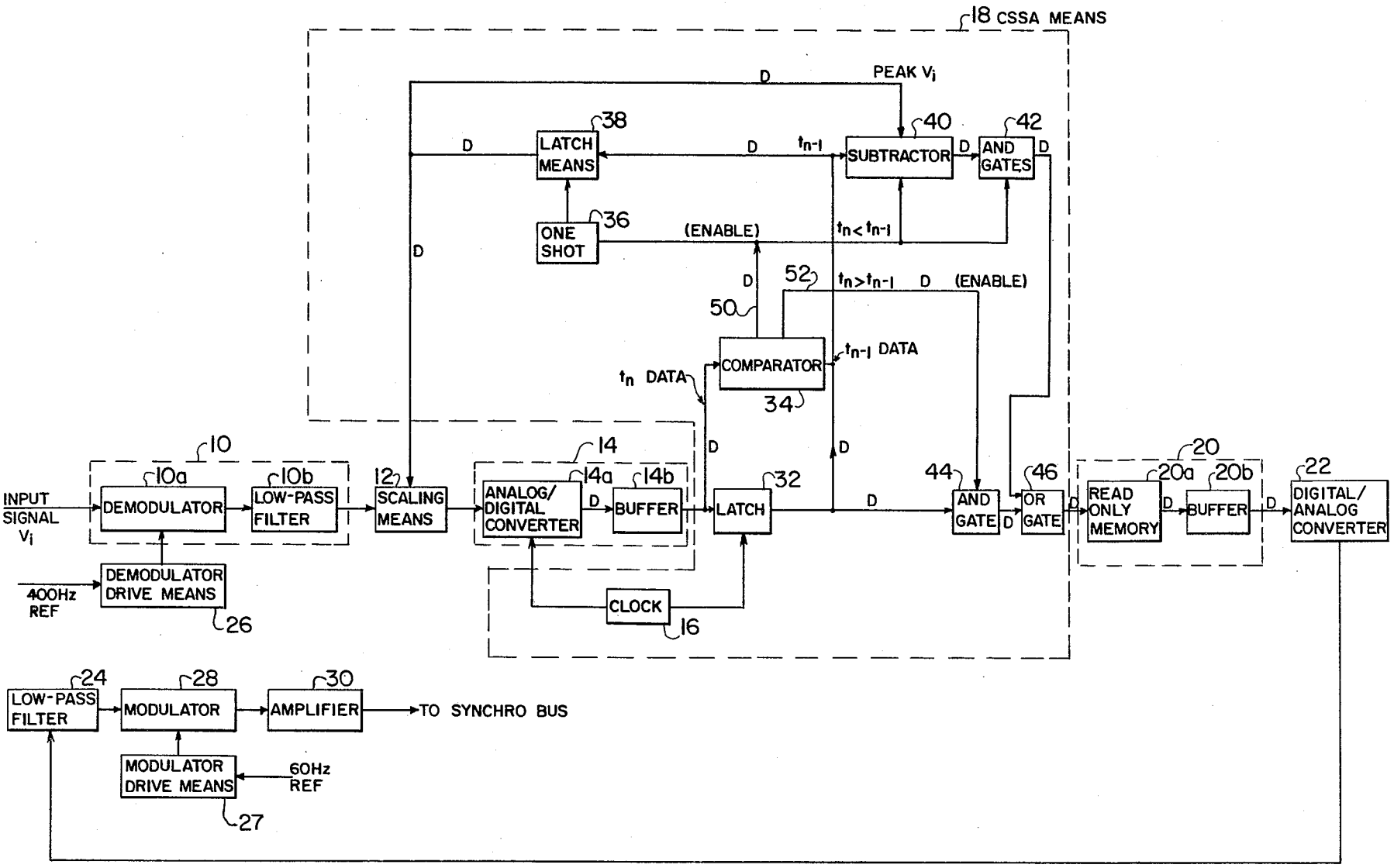
FIG. 4 is a block diagram of FIG. 1 in greater detail, showing especially the latching circuit used to remove the ambiguity arising when the desired output signal frequency is an even multiple of the frequency of the input signal.

Referring now to FIG. 4, the input synchro signal is fed to a demodulator and filter means 10. A demodulator drive means 26, which may be a square-wave generator providing square waves at the 400 Hz reference rate (if the input signal carrier frequency is 400 Hz), couples its output to the demodulator 10 which removes the carrier signal and provides the envelope of the input signal. The demodulator 10*a* of FIG. 4 includes a voltage divider, preferably adjustable, at its input so that the input signal can be adjusted to provide an output signal of desired unmodulated peak-to-peak value, for example, 2 volts peak-to-peak. A low pass filter 10*b* is used to prevent transients from reaching the output of the demodulator means 10.

The output of the demodulator/filter 10 is coupled to a scaling means 12 whose function is to correct for fluctuations in the value of the input voltage so that signals of the same peak-to-peak amplitude are fed to the A/D converter 14. The scaling means functions as an automatic gain control and is discussed hereafter in more detail.

The A/D converter 14 samples the scaled signal and produces a digital word corresponding to the amplitude of each sample. The words are fed to a read only memory (ROM) 20 either directly through a latch 32, AND gates 44 and OR gates 46 or, alternately, through a comparison, subtraction and scale adjustment (CSSA) circuit 18 and OR gates 46. The subtractor 40 and its associated gates 42 operate only when the output signal frequency is to be an even multiple (even harmonic) of the input signal frequency. The ROM 20 is programmed in the following manner. The A/D outputs are actually stepped values rather than continuous values. Each different stepped value is applied to a different specific address in the ROM which is associated with that stepped value, and a specific value for the output signal is stored at that address in the form of a digital word corresponding to an amplitude of the output signal. The output words of the ROM 20 are coupled into a digital-to-analog (D/A) converter 22 which provides an analog signal corresponding to the digital-word output of the ROM 20.

The analog signal is then smoothed by a low-pass filter 24 and fed to a modulator 28 which also receives a carrier signal from a drive means 27 to which the carrier signal is fed as an input. Thus, for example, if the system output signal is to be coupled back to a 60 Hz synchro system, the input to the modulator drive circuit 26 would be a 60 Hz signal. However, it could be a 400 Hz, or other frequency, carrier signal as desired. The modulator 28 output is a modulated carrier signal which, preferably, is fed to a power amplifier, or line driver, 30 before being put on a synchro bus. If the carrier signal frequency is the same in both input and output signals, a single drive means source can be used to feed the demodulator 10*a* and the modulator 28.

If the input signal does not involve a carrier frequency, it could be fed directly to the scaling amplifier 12, or it might require some filtering. Also, the output signal could be taken directly from the low-pass filter 24 if no output signal carrier is required. Modulation and amplification depend on the requirements of the circuit to which the output signal is to be fed.

Figure 5:
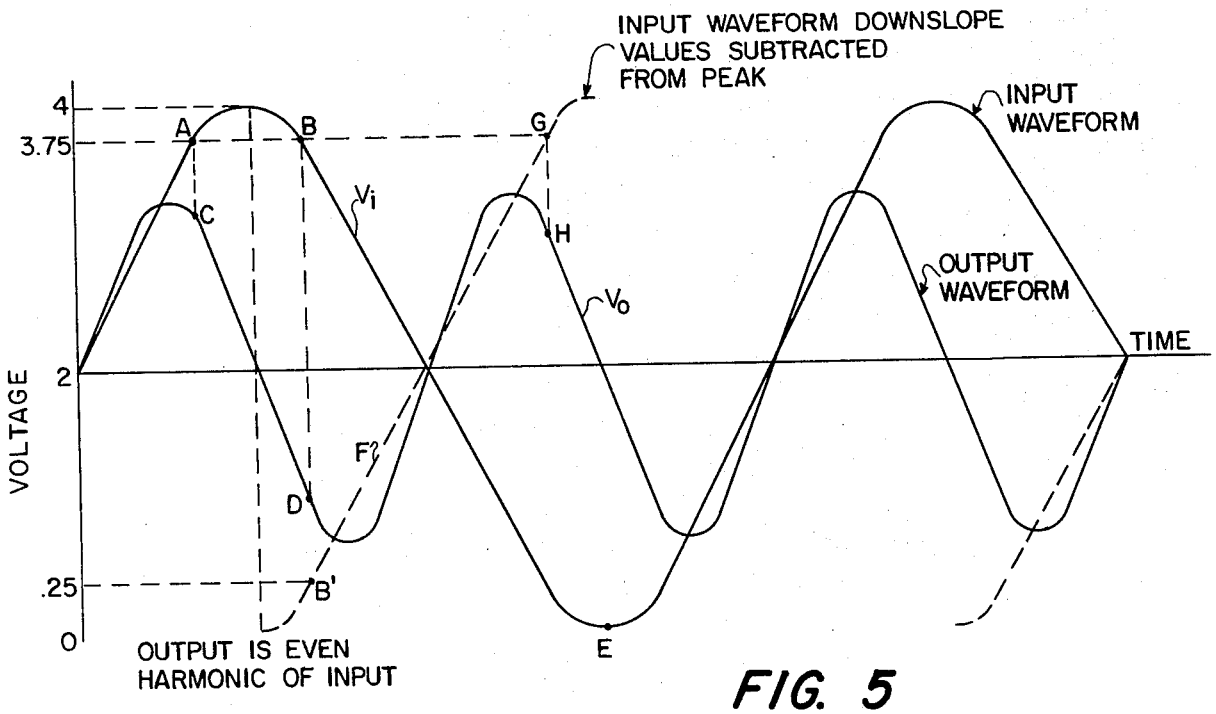
FIG. 5 is an illustration of an input and even-harmonic output wave showing why subtraction is necessary.

It should be noted at this point that when the output voltage is to be an odd multiple of the input voltage, the input voltage is passed directly through the latch 32 and gates to the ROM means 20. This is because there is no ambiguity in output signal values for equal input signal values or, to put it differently, equal input signal values correspond to equal output signal values because of symmetry considerations. Thus, an input signal value of x, whether on the increasing or decreasing slope of the wave will always correspond to an output signal value of y. However, this is not true for even harmonics of the input wave. As can be seen from FIG. 5, which shows a second harmonic output wave, points A and B on the input wave, which have the same voltage level, correspond to points C and D on the output wave, which have different voltage levels; thus, there is ambiguity present. To avoid this, a subtraction technique is used for the decreasing portions (the downslope) of the input wave. The input wave, which might be 2 volts peak-to-peak, is revalued so that the 0 volt level corresponds to the minimum negative value, i.e., point E. The maximum positive peak might then be 4 volts. Each sample value on the downslope would then be subtracted from the peak positive value giving the dashed line F, in effect. The dashed line provides unambiguous values for input voltage values. Thus, point B, which before had a value of approximately 3.75, is transformed by the subtraction to point B′ which has a value of approximately 0.25 volts.

Referring again to FIG. 4, the operation of the CSSA means 18 will now be described. As is apparent, the input signal to the latch 32 is present data, designated time $t_n$ data, whereas its output signal is data that was clocked in by the previous clock pulse from clock 16 and therefore can be called $t_{n-1}$ data. These signals, are fed to a comparator 34 which provides enable signals (i.e., the output line is high) on lines 50 and 52. An enable signal on line 50 indicates that $t_n < t_{n-1}$, that is, the input signal is on its downward slope, and an enable signal on line 52 indicates that $t_n > t_{n-1}$, that is, the input signal is on its upward slope.

If the input signal is on its upward slope ($t_n > t_{n-1}$), the line 52 is high enabling AND gates 44 allowing the input signal samples to pass through the AND gates 44 and OR gates 46 to the ROM means 20. However, if the input signal is on its downward slope ($t_n < t_{n-1}$), line 52 is low, disenabling the input data at AND gates 44, and line 50 is high, enabling the subtractor 40 and its following AND gates 42. The inputs to the subtractor are the peak value of the input signal (peak $V_i$), which is retained for a full cycle of the input signal by latch means 38, and the value of the $t_{n-1}$ signal from the output of latch 32. The subtractor feeds the difference in the value of these signals through the opened AND gates 42, which are now enabled and through the OR gates 46 to the ROM means 20.

The $t_n < t_{n-1}$ signal also operates the one-shot multivibrator 36 immediately after the input signal starts to decrease (in practice, this is effectively the peak value of the input signal $V_i$ and will be so referred to hereinafter). Reaching the peak value of the input signal causes line 50 to go high and the positive-going edge of the signal on line 50 fires the one-shot, strobing MV 36. This transfers the $t_{n-1}$ data present at the input of latch means 38 to its output, thereby placing the peak value of the input signal on its output. Line 50 remains high until the minimum value of the input signal $V_i$ is reached, at which time it goes low. However, this does not fire the one-shot 36 since it fires only on positive-going edges. Thus, the one-shot fires only once per cycle of the input signal $V_i$, and this occurs when $V_i$ reaches its peak value.

Figure 6:
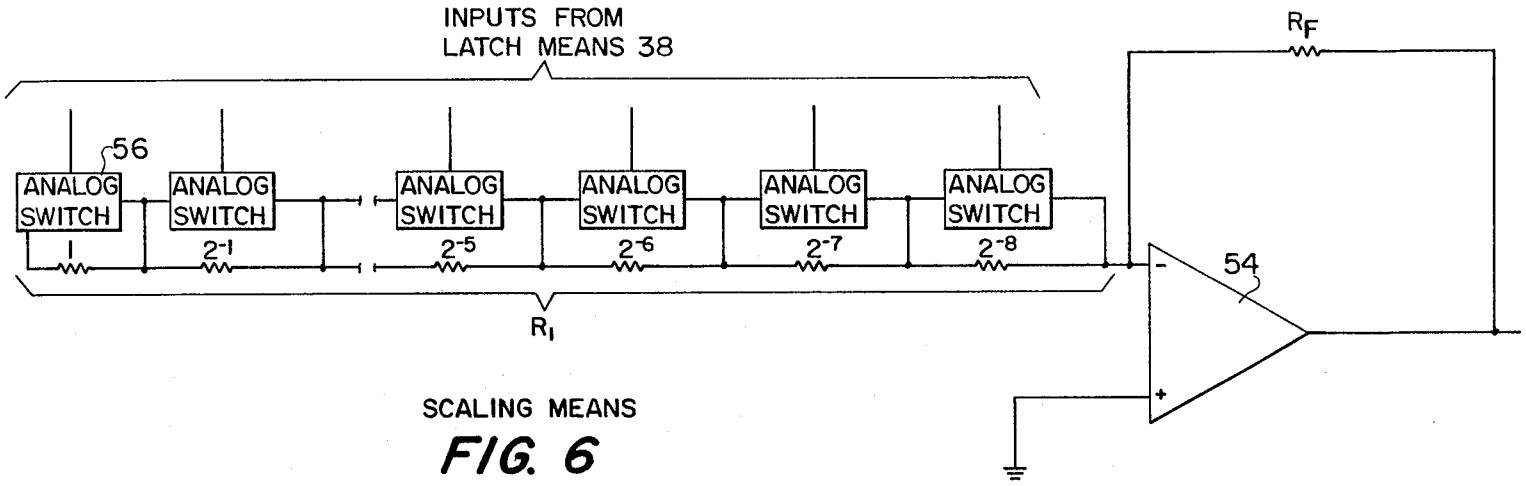
FIG. 6 is a circuit diagram of one type of scaling means.

Scaling means 12 includes a shorting circuit which operates in conjunction with the scaling amplifier 54 and its input resistors. As can be seen in FIG. 6, the input to the scaling means 12 comprises a series ($R_1$) of resistances, each in parallel with an associated analog switch 56, and the whole feeding an operational amplifier 54 with a feedback resistance of $R_f$. The gain of the scaling amplifier 12 is controlled by shorting out a portion of the series resistance $R_1$ by actuating the proper analog switch or switches. This permits precise control of gain down to the number of significant bits in the digital part of system. The voltage gain of the feedback amplifier 54 is:

$$A_v = \frac{R_f}{R_1}$$

Suppose that the scaling is such that $R_1$ is exactly 100,000 times the full-scale peak-to-peak voltage range, in this example 2 volts. Then:

$R_1 = 200K$ (nominal);

$R_F = 200K$;

$A_v = 1$.

Suppose now that the input voltage decreases to a $V_m$ (peak-to-peak) of 1.9 volts. The analog switches are activated to short out sufficient resistance so that:

$$R_1 = 1.9 \times 100{,}000 = 190K$$

The output voltage from the scaling amplifier 12 is:

$$V_{out} = V_m \frac{R_f}{R_1} = 1.9 \times \frac{200K}{190K} = 2 \text{ volts}$$

Similarly, if $V_m$ increases to 2.1 volts, less resistance is shorted out by the analog switches 56. Then:

$$R_1 = 2.1 \times 100{,}000 = 210K$$

-continued $$V_{out} = V_m \frac{R_f}{R_1} = 2.1 \times \frac{200K}{210K} = 2 \text{ volts.}$$

Figure 7:
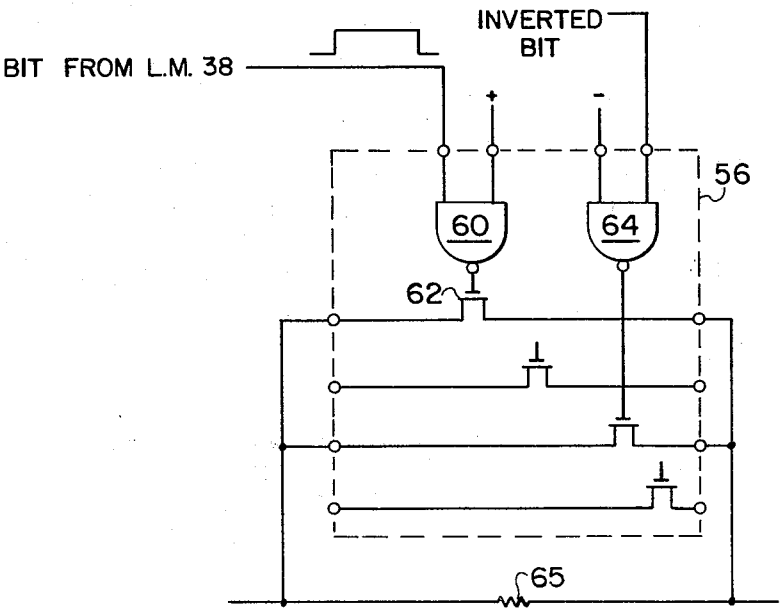
FIG. 7 is a circuit diagram illustrating an analog switch for use with the scaling amplifier.

The rescaling to correct for changes in the magnitude of the input signal occurs once each cycle. The digital output of the latching means 28 sets the amount of resistance shorted out each cycle. The outputs of the latching means 38 are the digital bits forming a digital word corresponding to the value of the $t_n$ signal from the comparator 34, the value being the peak value of the input signal Vi, since the one-shot MV 36 works only once per cycle of the input signal. The latching means 38 also provide an equal number of outputs which are the inversions of the signal-value bits. FIG. 7 shows how a NAND gate 60 and an FET gate 62 can be used as an analog switch to short out a resistor 65, which can be one of the series resistors composing the resistance $R_1$ of the scaling amplifier. A bit, or its inverted counterpart, can be used alternatively. Assuming bits are used, each bit output is fed to its own associated analog switch 56, being coupled to one input of the NAND gate 60, the other input always being enabled. The low output of the gate 60 causes the FET gate to conduct and short out the resistor 64. If the FET's conduct on a high signal, the inverted bit outputs and NAND gate 64 would be used.

The following equipment is illustrative of the types of circuits which can be used as components in the designated blocks of the system described herein. Other companies also manufacture the same or similar solid-state devices.

| | |
|---|---|
| demodulator 10a | National Semiconductor Model LH 0019 |
| A/D Converter 14a | TRW TDC1007PCB |
| latch 32 | Fairchild Semiconductor TTL/MSI 7475 |
| ROM means 20a | EPROM MM1702 |
| D/A converter 22 | Analog Devices AD 559 |
| comparator 34 | Fairchild Semiconductor TTL/MSI 9324 |
| subtractor 40 | Fairchild Semiconductor TTL/MSI 9340 |
| latch means 38 | Fairchild Semiconductor TTL/MSI 7475 |
| OR gates 46 | Fairchild Semiconductor TTL/SSI 9N32/5432, 7432 |
| AND gates 42, 44 | Fairchild Semiconductor TTL/SSI 9N08/5408, 7408 |
| one-shot MV | Fairchild Semiconductor TTL/Monostable 9603/54121, 74121 |
| modulator 28 | National Semiconductor LH0019 |
| modulator drive means 26 | National Semiconductor chip DM7800 with chip MM450 |
| analog switch 56 | National Semiconductor LH0019 |
| buffers 14b | Fairchild Semiconductor TTL/SSI 7408 |

It should be noted that if the output signal is always to be an odd multiple of the input signal, the subtraction circuit would be unnecessary, in which case blocks 40, 42, 44 and 46 could be dispensed with. The output of the latch 32 could then be fed directly to the ROM 20*a*.

Obviously, many modifications and variations of the present invention are possible in light of the above teachings. It is therefore to be understood that, within the scope of the appended claims, the invention may be practiced otherwise than as specifically described.

What is claimed is:

1. A signal conversion circuit for converting a periodic, analog, electrical input signal into an output signal differing from the input signal in amplitude and/or frequency and/or phase comprising:

scaling means for changing the amplitude of the input signal so that the peak thereof equals a preselected value;

A/D converter means operatively connected to said scaling means for sampling the amplitude of the input signal and changing the sampled values to an equivalent set of digital words, each digital word corresponding to the value of its associated sample;

a comparison, subtraction and scale adjustment (CSSA) means operatively connected to said A/D converter means and to said scaling means for receiving the output of said A/D converter means and storing it until the next output thereof is received, and for comparing each present output sample ($t_n$) of said A/D converter means with its prior output sample ($t_{n-1}$) once each cycle of the input signal $V_i$ of said signal conversion circuit, the present and prior output samples being used to correct the scaling of said scaling means;

ROM means operatively connected to said CSSA means so as to receive the output of said A/D converter means, in the form of output digital words, for storing at each digital word address thereof another digital word in accordance with pre-programmed values corresponding to the values of a desired output signal; and D/A converter means operatively connected to said ROM means for converting the output digital words thereof into corresponding analog values.

2. The signal conversion circuit of claim 1 further comprising, smoothing means operatively connected to said D/A converter means for converting the analog values therefrom into corresponding smooth continuous waveforms.

3. The signal conversion circuit of claim 2 further comprising:

means for receiving a modulated input signal and removing the carrier frequency thereof so as to feed the envelope of the modulated input signal to said scaling means; and means for receiving the output of said smoothing means as an input signal and using it to modulate a carrier frequency to provide a modulated carrier signal as the output of said signal conversion circuit.

4. The signal conversion circuit of claims 3 or 1 in which said CSSA means further comprises:

a first latch for receiving the output of said A/D converter means and storing it until the next A/D output signal is received, the signal at the input of said first latch being the present ($t_n$) output sample of said A/D conversion means and the signal at the output of said first latch being the prior ($t_{n-1}$) output sample;

a comparator for comparing each $t_n$ sample with each prior $t_{n-1}$ sample and providing a first output signal which is high only when $t_n > t_{n-1}$ and a second output signal which is high only when $t_n < t_{n-1}$;

first AND gates for receiving the output of said first latch and the first output signal from said comparator for passing through to said ROM means the output of said first latch when the first output signal from said comparator is high ($t_n > t_{n-1}$);

a second latch including a latch circuit portion and a one-shot multivibrator (MV) portion, said latch circuit portion receiving the $t_{n-1}$ sample at its input and said MV portion receving the second output signal from said comparator at its input, said MV portion operating on the leading edge of the second output signal to activate the operation of said latch circuit portion so that the signal at the output thereof is always the peak value of the input signal $V_i$ for a single cycle thereof;

subtraction means for receiving as a first input the peak value of the input signal $V_i$ from the output of said latch circuit portion of said second latch, as a second input the $t_{n-1}$ sample from said first latch and as an enabling signal the second output signal from said comparator, and operating to substract the $t_{n-1}$ sample from the peak value of the input signal $V_i$ to obtain a difference signal when the second output signal from said comparator is high ($t_n < t_{n-1}$) and for passing on the difference signal to said ROM means only when $t_n < t_{n-1}$;

second AND gates for receiving the output of said substraction means as a first input and the second output signal from said comparator as a second input; and OR gates having inputs connected to the outputs of said first and second AND gates and having outputs connected to input lines of said ROM means.

* * * * *